US006450096B1

(12) United States Patent
Koppelkamm et al.

(10) Patent No.: US 6,450,096 B1
(45) Date of Patent: Sep. 17, 2002

(54) APPARATUS AND METHOD FOR CHANGING FLEXIBLE PRINTING PLATES

(75) Inventors: Günter Koppelkamm, Neuensalz; Matthias Dunger, Erlbach; Heiko Roth, Kürbitz; Reiner Hamann, Klingenthal, all of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 60 days.

(21) Appl. No.: 09/678,873

(22) Filed: Oct. 2, 2000

(30) Foreign Application Priority Data

Oct. 1, 1999 (DE) ..... 199 47 173

(51) Int. Cl.[7] ..... B41L 47/12; B41F 27/12
(52) U.S. Cl. ..... 101/477; 101/415.1; 101/389.1
(58) Field of Search ..... 101/415.1, 477, 101/389.1

(56) References Cited

U.S. PATENT DOCUMENTS 5,595,119 A * 1/1997 Hada et al. ..... 101/415.1
6,216,594 B1 * 4/2001 Nakano et al. ..... 101/477

FOREIGN PATENT DOCUMENTS

| | | | |
|---|---|---|---|
| DE | 43 22 027 A1 | | 1/1995 |
| DE | 195 08 844 C2 | | 12/1996 |
| DE | 198 38 777 A1 | * | 3/2000 |
| DE | 198 38 777.2 | | 3/2000 |

* cited by examiner

*Primary Examiner*—Leslie J. Evanisko
(74) *Attorney, Agent, or Firm*—Cohen, Pontani, Lieberman & Pavane

(57) ABSTRACT

An apparatus for changing flexible printing plates on a plate cylinder of printing machines having a simple, compact and space-saving construction is provided. The apparatus includes two magazines arranged beside each other, to hold the printing plates to be inserted and removed. A transporting arrangement pivotably mounted on a shaft is beside the magazines. A holding arrangement which is on the transporting means is used both to grip and guide a printing plate to be inserted and to grip and guide a printing plate to be removed. The magazines and the transporting arrangement are mounted in a frame that can be pivoted towards and away from the plate cylinder. The invention further relates to a method of changing flexible printing plates on a plate cylinder of a printing machine.

20 Claims, 13 Drawing Sheets

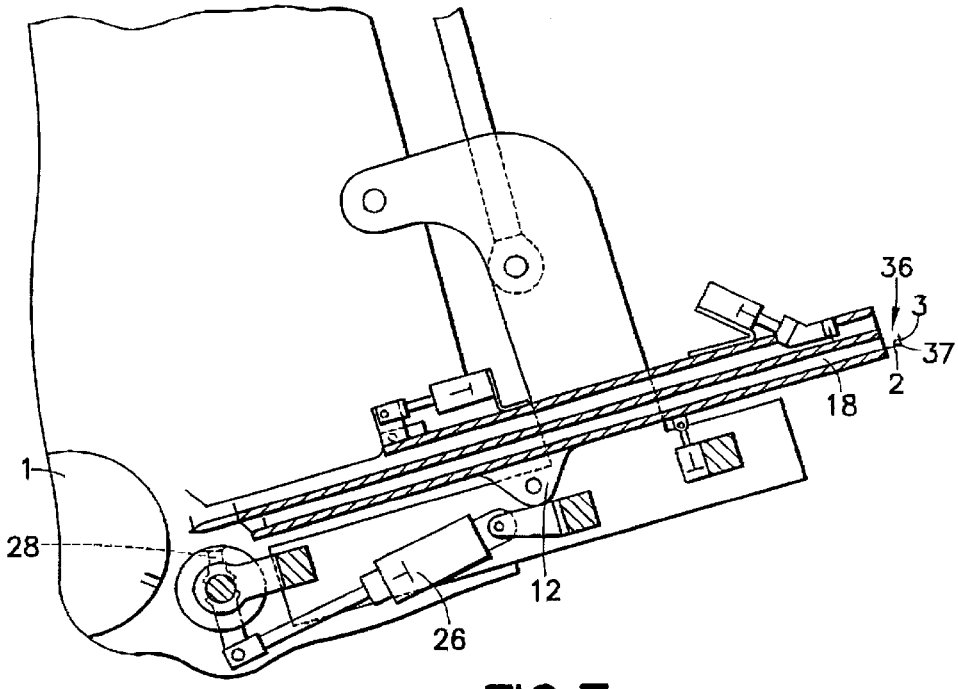
FIG.7
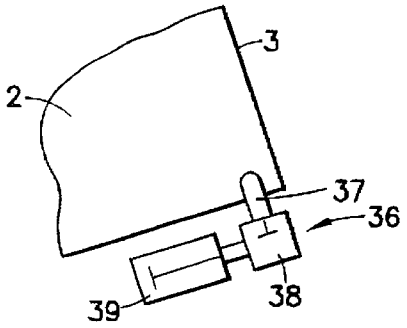
FIG.7.1
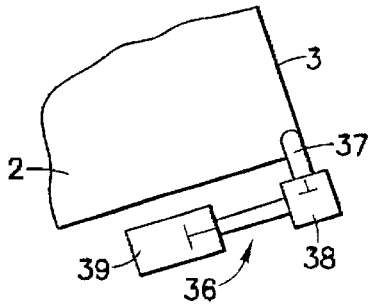
FIG.7.2

APPARATUS AND METHOD FOR CHANGING FLEXIBLE PRINTING PLATES

BACKGROUND OF THE INVENTION

1. Field of the Invention

The present invention relates to an apparatus for changing flexible printing plates on a plate cylinder of a printing machine. More particularly the present invention relates to an apparatus including two adjacent magazines for two respective printing plates, a transporting arrangement beside the magazines, and a holding means for gripping and gliding the printing plates. The apparatus allows for ready access to the plate cylinder for maintenance and the like.

2. Description of the Related Art

German reference DE 43 22 027 A1 discloses an apparatus for changing printing plates on a plate cylinder of a rotary printing machine, including devices for inserting and removing the print plate arranged so that they can be pivoted with respect to the plate cylinder. The disadvantage of this configuration is that accessibility to the plate cylinder is very restricted, since the working cylinders that pivot the devices for feeding the printing plate and removing it are arranged so that they cross in the drive-side frame side wall. In addition, in this type of an arrangement, the space below the pivoting devices is small, so that the distance of the devices from the plate cylinder, after they have been pivoted away into a park position, is not sufficient to perform maintenance work on the plate cylinder without being a physical hindrance.

A further configuration of the prior art makes access to the plate cylinder difficult, in that in order to change the printing plates, pressure rollers with actuating rollers which can be set against the plate cylinder are required. These rollers are physically separate from the devices for inserting and removing the printing plate. A further disadvantage of DE 43 22 027 A1 is apparent when separating the printing plate to be removed from the plate cylinder. There, release of the end of the printing plate that is clamped in the clamping channel of the plate cylinder has to be performed by a mechanism in the clamping channel that releases the clamped end of the printing plate from the clamping device.

From the earlier patent application 198 38 777.6, not yet previously published, an apparatus for changing printing plates on a plate cylinder of a rotary printing machine is known. There, a carriage which can be displaced towards the plate cylinder and contains pivotable holding means is disclosed. The holding means is fitted between the device for inserting the printing plate and the device for removing the printing plate. The disadvantage of this configuration is that the displaceable carriage in the apparatus for changing plates is relatively high, which contrasts with the low space available in rotary printing machines.

German reference DE 195 08 844 C2 discloses an apparatus for changing printing plates on a plate cylinder of a printing machine, where the magazines for the printing plate to be inserted and removed are separated by a transporting means that passes through the magazines and is fitted on both sides with suction-type devices that are used to grip and guide the printing plates. The disadvantage of this configuration is that since the transporting means is between the magazines the apparatus is relatively high. As a result, already restricted space between the printing units is further limited, further impeding accessibility to the plate cylinder.

A further disadvantage of DE 195 08 844 C2 is that although there is a transporting means to transport the printing plate to be inserted and removed, suction devices facing the printing plate are required on the transporting means in order to guide and grip the printing plate. This further interferes with a compact overall height and also increases the costs of the apparatus.

SUMMARY OF THE INVENTION

The invention is based on the object of providing an apparatus for changing flexible printing plates which has a simple, compact and space saving construction.

According to the present invention, the object is achieved by an apparatus for changing flexible printing plates on a plate cylinder of printing machines having a simple, compact and space-saving construction. The apparatus includes two magazines arranged beside each other, to hold the printing plates to be inserted and removed. A transporting arrangement pivotably mounted on a shaft is beside the magazines. A holding arrangement which is on the transporting means is used both to grip and guide a printing plate to be inserted and to grip and guide a printing plate to be removed. The magazines and the transporting arrangement are mounted in a frame that can be pivoted towards and away from the plate cylinder. The invention further relates to a method of changing flexible printing plates on a plate cylinder of a printing machine.

A significant advantage of the present invention is that it provides the required functional elements, in a small space, in an apparatus which is of simple construction and is easy to handle.

It is a further object of the present invention to avoid the necessity of using additional bulky devices. To this end, a separate pressure roll is not required for the printing plate. Specifically, the apparatus of the present invention can be readily mounted in a pivotable frame and can therefore be moved completely away from the plate cylinder. This ensures accessibility of the plate cylinder for maintenance work.

A still further object of the present invention is to provide an effective means of moving the printing plates. According to the present invention, a further significant advantage is achieved in that the transporting means bears the holding means and is configured so that it is arranged between the magazines and the plate cylinder and can be pivoted. As a result, the holding means can grip both the printing plate to be inserted and the printing plate to be removed, and can guide them to and from the plate cylinder, respectively. Suitable holding means may, for example, be suction devices that can be loaded both with vacuum and with pressure by an air supply system.

A further advantage of the present invention is that the magazines are additionally arranged in a frame which can be moved by means of a drive device, so that both the magazine for the printing plate to be inserted into the plate cylinder and the magazine for holding the printing plate to be removed from the plate cylinder can be set against the holding means.

A further significant advantage arises in that the drive device used to pivot the entire apparatus can also perform both an insertion movement of the leading end of the printing plate to inserted into a channel of the plate cylinder, and a removal movement of the trailing end of the printing plate to be removed from the channel in the plate cylinder.

The present invention also relates to a method for changing flexible printing plates on a plate cylinder of a printing machine providing an easy way to change printing plates.

The method will be understood from the following detailed description in conjunction with the drawings.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is described in detail below with reference to the accompanying drawings, in schematic form as follows:

FIG. 7 is an apparatus according to FIG. 2 with the printing plate fully inserted into the magazine and arrested by means of an apparatus, FIG. 7.1 and FIG. 7.2 are partial sections of the apparatus according to FIG. 7 with apparatus components that insert and arrest the printing plate;

DETAILED DESCRIPTION OF THE PRESENTLY PREFERRED EMBODIMENTS

Figure 1:
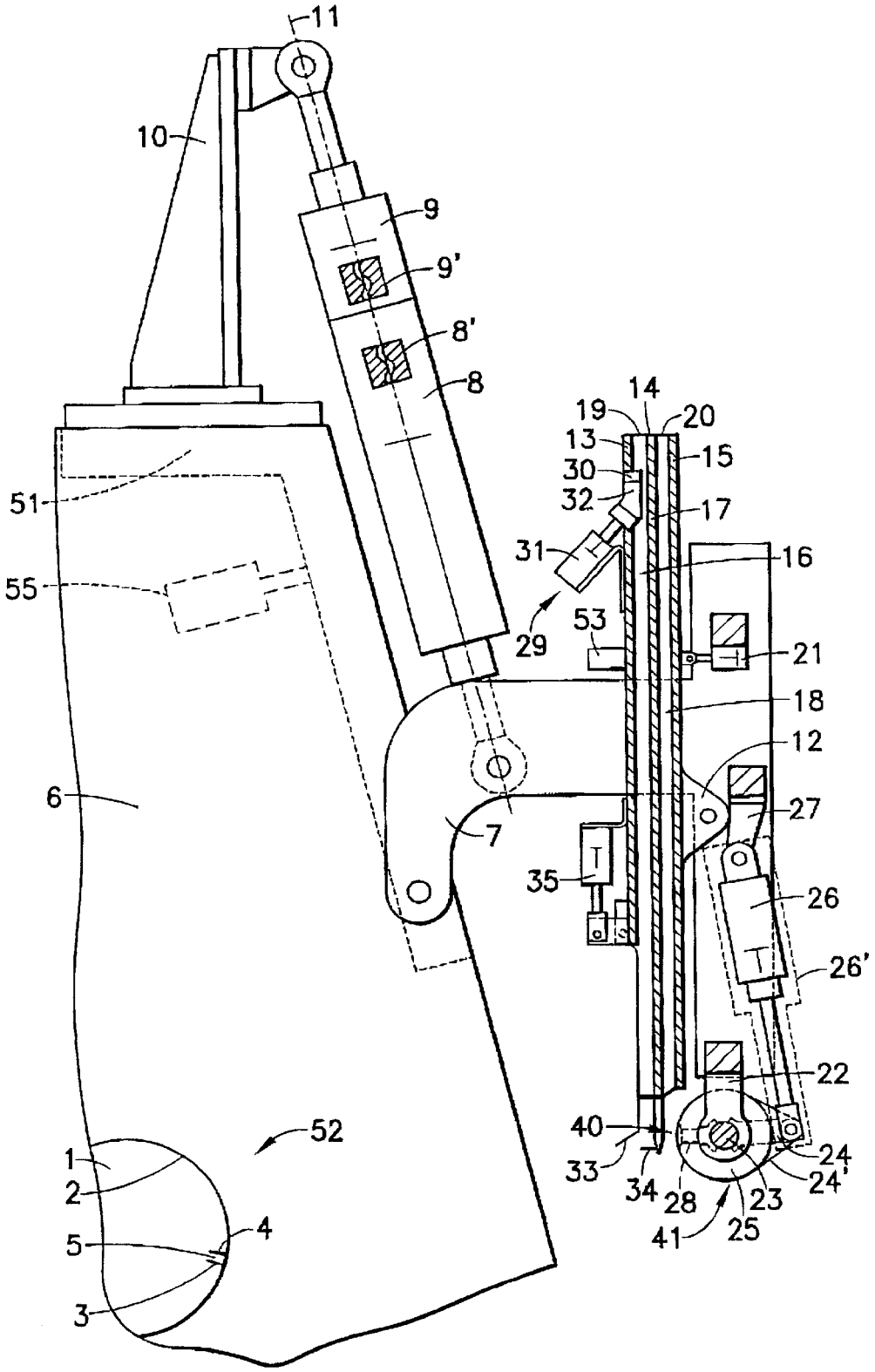
FIG. 1 is an apparatus according to the present invention in the park position.

Referring now to FIG. 1, a plate cylinder 1 is shown on the circumference of which is clamped a flexible printing plate 2, the bent end 3 of which trails in the direction of rotation of the plate cylinder 1. A leading bent end 4 of the flexible printing plate 2 is inserted into a radial channel 5 in the plate cylinder 1 and secured against sliding out of the channel inadvertently. The plate cylinder 1 is mounted in a conventional way between frame walls 6 in a printing machine. In order to change the printing plate on the plate cylinder 1, there is an apparatus including a frame 7 mounted so that it can be pivoted on the frame wall 6. The apparatus is pivoted by means of two working cylinders 8, 9. The pivoting can alternatively be carried out by an electromechanical motor or a screw and nut drive which are generically indicated as 8', 9'. The construction of such motors and drives is known to those skilled in the art. One working cylinder 8 is rotatably mounted on the frame 7 and loaded by a pressure medium. The other working cylinder 9 is loaded by a pressure medium and is mounted so that it can move on a supporting element 10 connected to the frame wall 6. As FIG. 1 shows. both working cylinders 8, 9 can be arranged linearly on a common shaft 11. Alternatively, a mutually offset or angled arrangement of the working cylinders 8, 9 is also possible.

It is also possible for the frame 7 to be pivoted using only one of the aforementioned working cylinders or with other drives. A further frame 12 is pivotably mounted on the frame 7.

Guide elements 13–15 are provided on the frame 12. The guide elements 13, 14 are arranged at a distance from each other and form a magazine 16 for a printing plate 17 to be inserted. Guide elements 14, 15 form a magazine 18 for the printing plate 2 to be removed from the plate cylinder 1. The magazine 16 has a feed opening 19 and a discharge opening 20 near the top. A light barrier 53 is arranged on the guide element 13 associated with the magazine 16.

The frame 12 is pivoted by means of a working cylinder 21 which is loaded by a pressure medium and is mounted on the frame 12 and the frame 7. At the lower end of the frame 7, a shaft 23 is arranged by means of load bearing elements 22 so as to be axially parallel with the plate cylinder 1. Pivotable transporting elements 24, 24' and rotatably mounted supporting elements 25 (which are curved in the opposite direction to the plate cylinder 1) are arranged on the shaft 23. The transporting elements can include a lever 24 or a disc or circular segment 24'.

The transporting elements 24 are pivoted by means of a further working cylinder 26 (or an electromechanical motor or screw and nut drive generically indicated with 26') that is loaded by a pressure medium and is mounted so that it can move between the transporting elements 24 and a supporting element 27 fixed to the frame 7. Holding means 28 are arranged on the transporting elements.

In an embodiment of the present invention described above, the shaft 23 can be mounted such that it rotates. The transporting elements 24 and/or the supporting elements 25 are arranged to be fixed on the rotating shaft 23. In this embodiment, the shaft 23 is connected to a drive (not shown), which is, for example, the aforementioned working cylinder 26. It is possible to use other drive devices, for example a motor which is flange-mounted on the shaft 23 or connected to the shaft 23 by a flexible drive. An arresting device 29 is fitted to the guide element 13 of the magazine 16 for inserting the printing plate 17. The arresting device 29 arrests a trailing end 30 of the printing plate 17 and aligns it in register. In this case, the arresting device 29 comprises an angular element 32 which can be set onto and off the trailing end 30 by means of a working cylinder 31.

Fixed at the other end of the guide element 13 is a hold-down or retaining means 33, which presses a leading end 34 of the printing plate 17 to be inserted onto the holding means 28. The holding means 28 is pivoted by means of a working cylinder 35.

An insertion device 36 is assigned to the magazine 18 as shown in FIG. 7, FIG. 7.1 and FIG. 7.2. This includes an actuating element 37 that fixes the trailing end 4 of the printing plate 2. The actuating element 37 is arranged on working cylinder 38 and can be set on and off by means of the working cylinder 38. In addition, the insertion device 36 includes a working cylinder 39 which is mounted on the magazine 18. When the working cylinder 39 is extended, the fixed printing plate 2 is fully inserted into the magazine 18 and drawn out of or removed from the area of the holding means 28. Each of the pressure medium operated working cylinders (21, 26, 31, 35, 38, 39) can be replaced by other drives, for example, motors or screw-and-nut drives.

Referring now to FIG. 1, the transporting elements 24 are configured as lever like elements, however it is also possible to use elements shaped like discs, circular segments or the like.

In the embodiment shown, the holding means 28 arranged on the transporting element 24 are designed as suckers or suction like elements 28 which can be loaded both with a vacuum (−P) and with a positive pressure (+P) via an air supply system. The holding means 28 pass through the supporting elements 25 which are rotatably mounted on the shaft 23 and configured as elements shaped like rods, discs, circular segments or the like.

The suction like elements or suckers 28 are connected to the air supply system (not illustrated) via bores (also not illustrated) located in the transporting elements 24 and in the shaft 23 or via tube and hose connections laid on and in the transporting elements 24 and the shaft 23. A further variant of the holding means 28 is, rather than using suckers 28, to configure the holding means 28 with an adhering zone 40, which can be a magnetizable adhering zone. In this case, the printing plate 2, 17 must be prepared so that it can react to a magnetic force.

In order to prevent damage to the printing plate 17, the elements forming the supporting elements 25, are provided with a coating 41 to prevent sliding or deposition of ink residues by the changed printing plate. Additional elasticity of this coating 41 is advantageous for this purpose.

FIGS. 1 to 11 show the changing of the printing plates 2, 17 on the plate cylinder 1, FIGS. 2 to 7 show the removal of the printing plate 2 from the plate cylinder 1, and FIGS. 8 to 11 show the action of laying the printing plate 17 on the plate cylinder 1.

Referring now to FIG. 1, the apparatus for changing the printing plate 2 is shown in the park position. The printing plate 17 to be inserted is located in the magazine 16, and is prevented from sliding out prematurely by means of the arresting device 29 at its trailing end 30. This printing plate 17 has been inserted into the magazine 16 via the feed opening 19 by a machine operator with the leading end 34 of this printing plate 17 having been detected by the light barrier 53 as it was inserted. The light barrier 53 sends a signal to a control device (not shown), which causes the arresting device 29 to be set against the printing plate 17. Thus, when the printing plate 17 is inserted fully into the magazine 16, the arresting device 29 aligns the printing plate 17 in register at its trailing end 30 and prevents it from sliding out prematurely.

Figure 2:
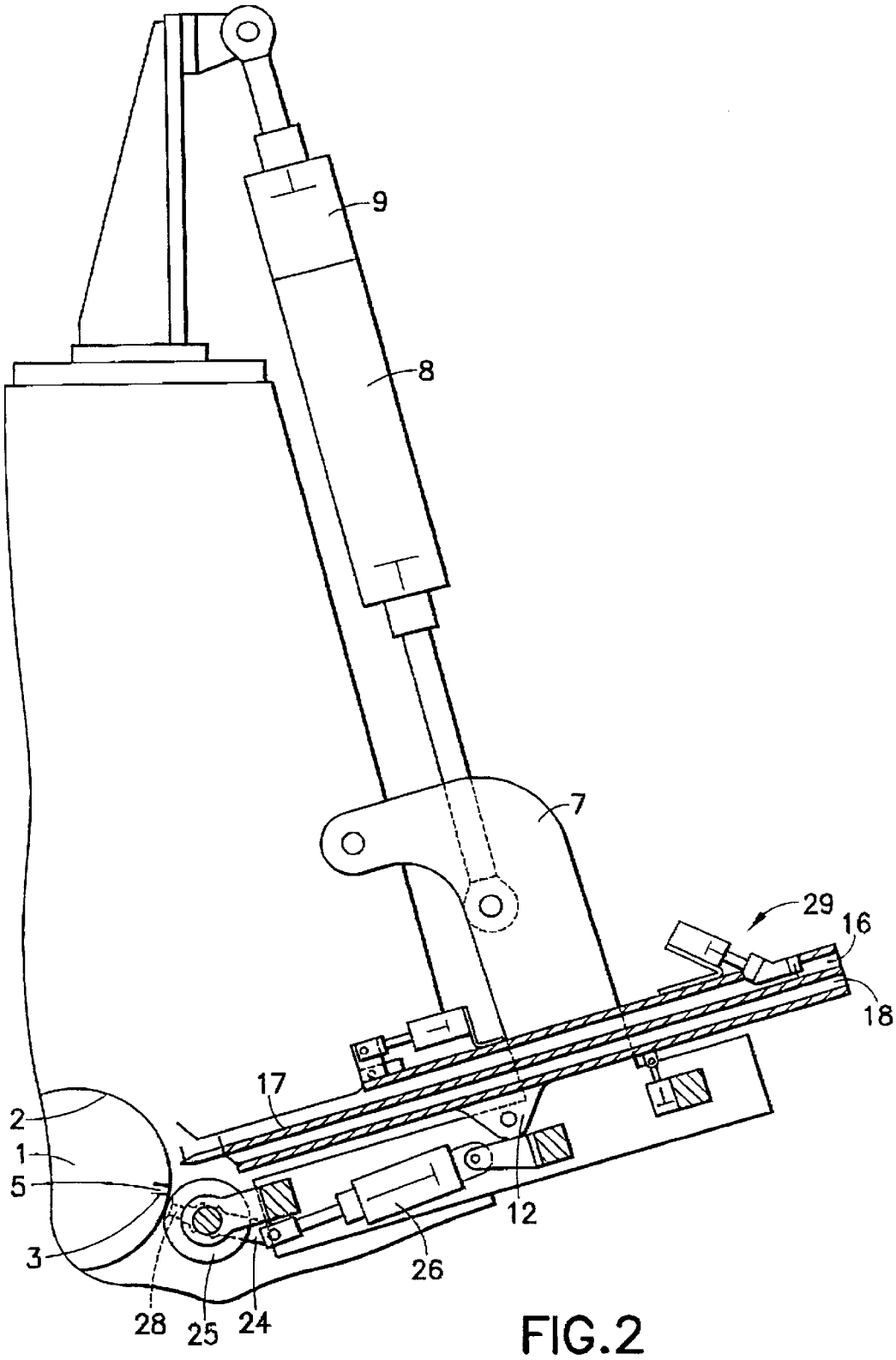
FIG. 2 is an apparatus according to FIG. 1 in the operating position, set against the plate cylinder, with holding means positioned on a trailing end of the printing plate.

Referring now to FIG. 2, the operating position is shown. The plate cylinder 1 fitted with the printing plate 2 is stationary in this position. The apparatus is moved into the operating position by means of pivoting the frame 7 by extending the working cylinders 8, 9. The suckers 28 arranged on the transporting elements 24 are positioned in the area of the trailing end 3 of the printing plate 2 by means of retracting the working cylinder 26. The trailing end 3 trails in the direction of rotation of the plate cylinder 1. The printing plate 2 adheres to the suckers 28 to which a vacuum (−P) is applied. A new printing plate 17 is ready in the magazine 16.

Figure 3:
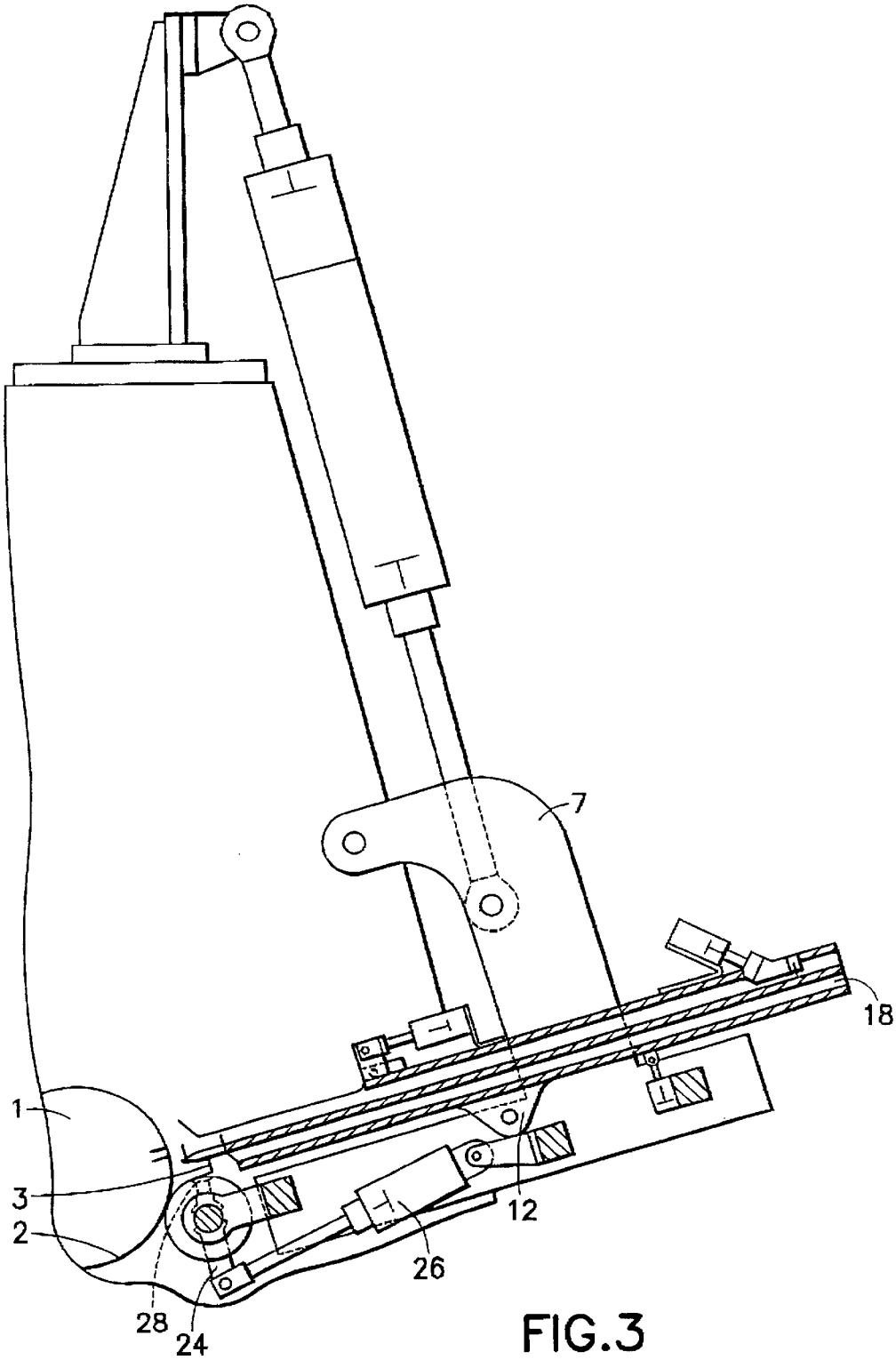
FIG. 3 is an apparatus according to FIG. 2 with the holding means releasing the printing plate being removed from the printing cylinder in the area of a magazine for removing the printing plate.

Referring now to FIG. 3, the holding means 28 releasing the plate being removed is shown. The suckers 28 draw the trailing end 3 into the area of the magazine 18 for removing the printing plate, by simultaneously rotating the plate cylinder 1 and pivoting the suckers 28 arranged on the transporting elements 24 by means of extending the working cylinder 26, and subsequently release this trailing end 3 by means of a pneumatic pressure pulse. The plate cylinder 1 continues to rotate and thus pushes this trailing end 3 further into the magazine 18.

Figure 4:
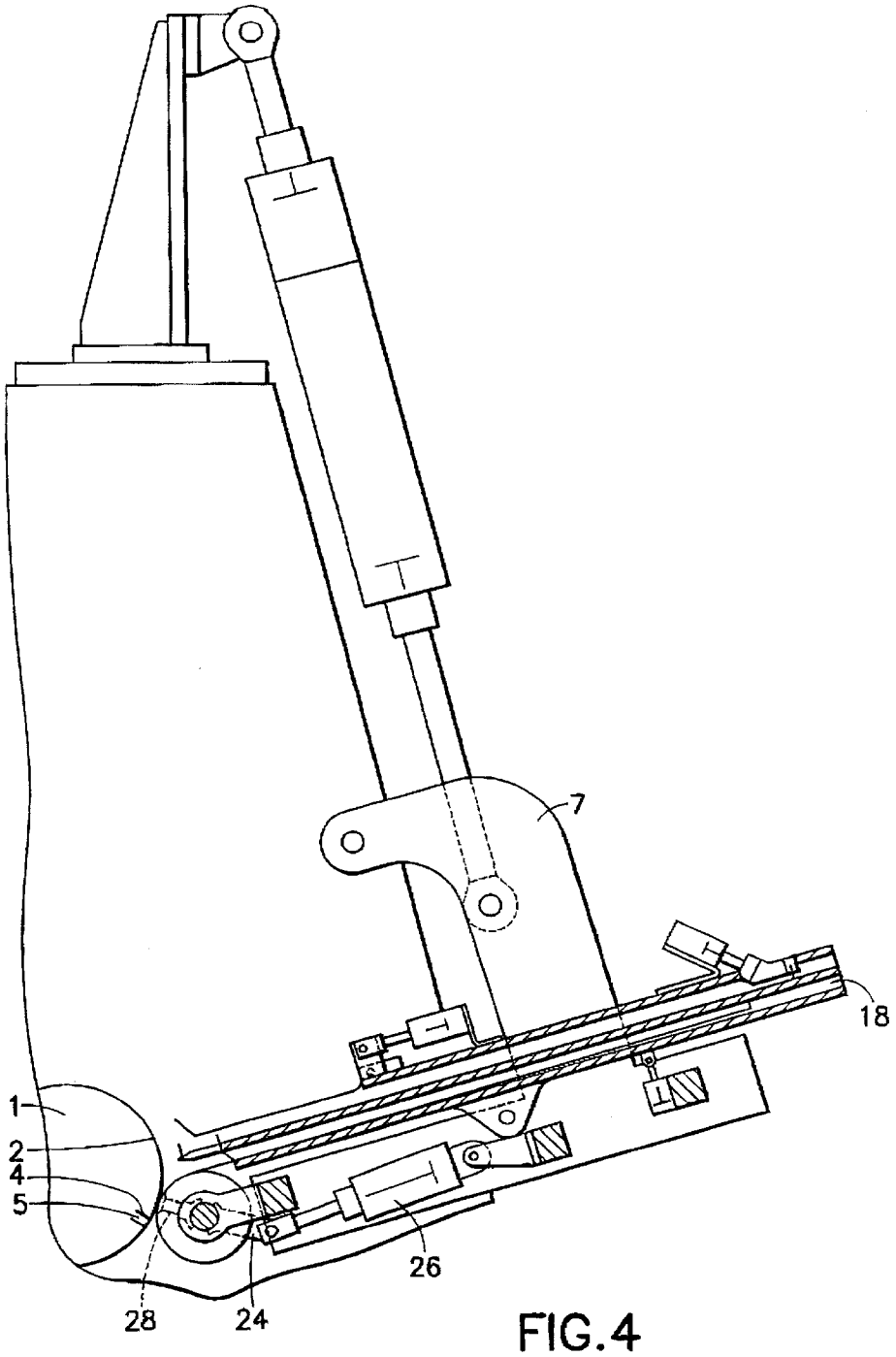
FIG. 4 is an apparatus according to FIG. 2 with holding means positioned in the area of the leading end of the printing plate.

Referring now to FIG. 4, the holding means positioned toward the leading end 4 of the printing plate 2 is shown. The plate cylinder 1 has rotated into the changing position, and the suckers 28 have been pivoted into the area of the leading end 4 of the printing plate 2 by retracting the working cylinders 26. The printing plate 2 adheres to the suckers 28, to which a vacuum (−P) is applied.

Figure 5:
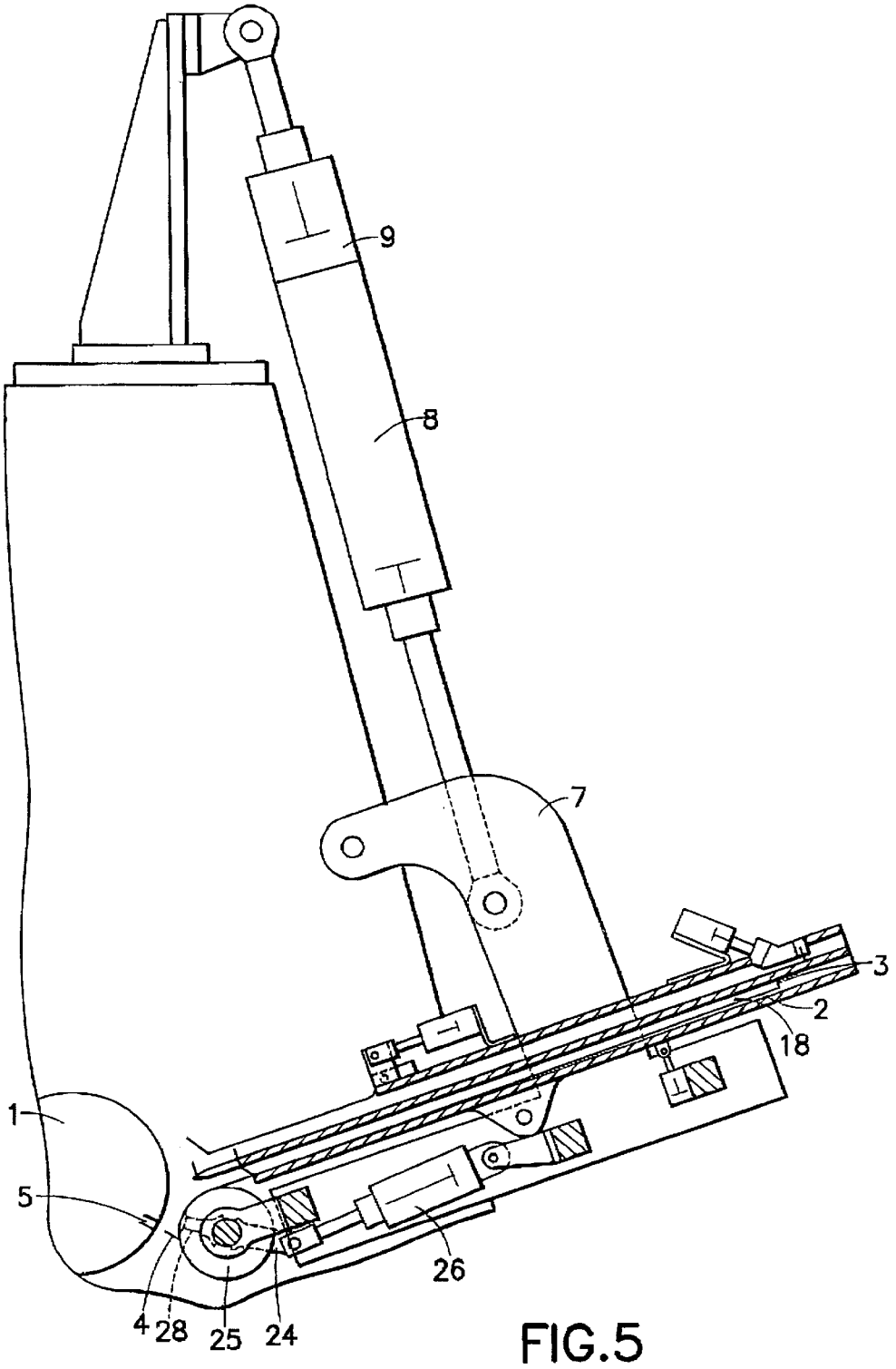
FIG. 5 is an apparatus according to FIG. 2 with the frame moved away from the plate cylinder and a bent, leading end of the printing plate drawn out of the channel in the plate cylinder.

Referring now to FIG. 5, the frame 7 having been moved away from the plate cylinder 1 by means of retracting the working cylinder 9 is shown with the leading end 4 of the printing plate 2 being drawn out of the channel 5 by means of the suckers 28 (to which a vacuum (−P) is applied).

A further embodiment for withdrawal of the leading end 4 out of the channel 5 by means of the suckers 28, to which a vacuum (−P) is applied, is possible if the working cylinder 9 is arranged on the frame 7 that pivots the load-bearing elements 22 (that bear suckers 28), with the load-bearing element 22 being flexibly mounted on the frame 7.

Figure 6:
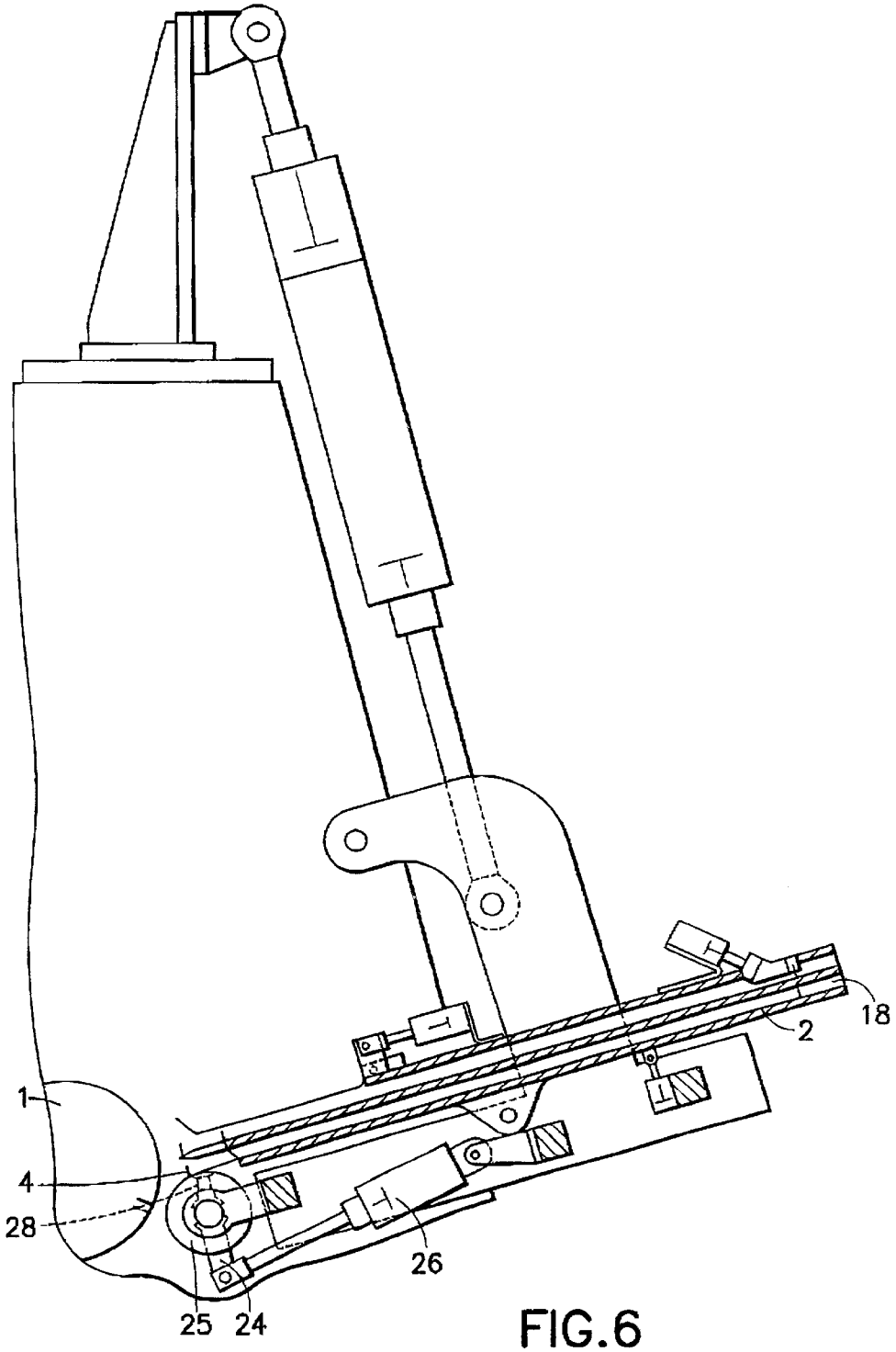
FIG. 6 is an apparatus according to FIG. 2 with the printing plate partly inserted into the magazine to remove it.

Referring now to FIG. 6, the printing plate 2 is shown being pushed further into the magazine 18 by the transporting elements 24 with the working cylinder 26 being extended.

Referring now to FIG. 7, the trailing end 3 of the printing plate 2 is initially fixed by the insertion device 36 arranged in the magazine 18. The printing plate 2 is released by the suckers 28 by means of a pneumatic pressure pulse and is subsequently inserted fully into the magazine 18 by means of the working cylinder 39 of the insertion device 36, and is therefore removed from the area of the suckers 28 (see FIG. 7.1 and FIG. 7.2).

Figure 8:
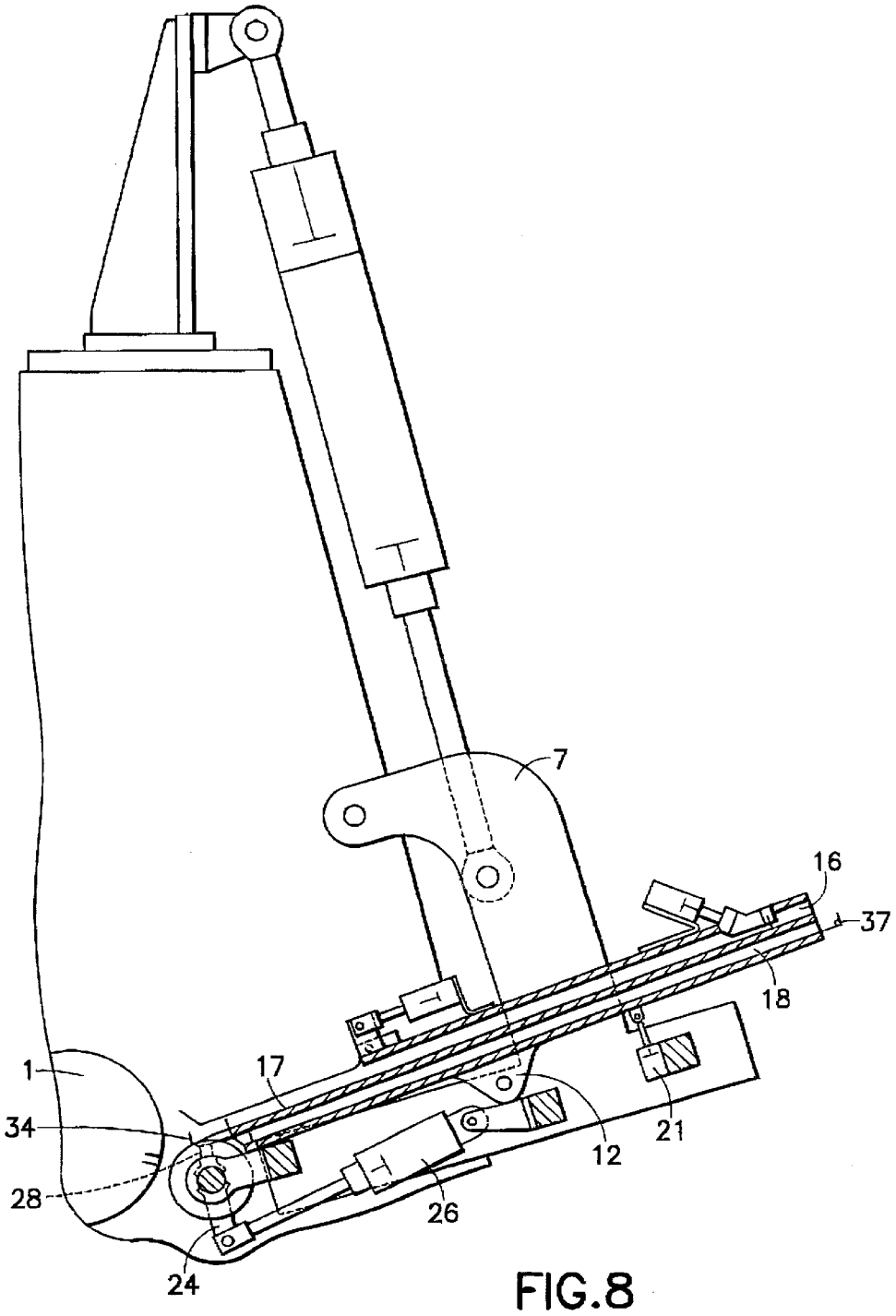
FIG. 8 is an apparatus according to FIG. 2 with the holding means taking a new printing plate out of a magazine for inserting a printing plate.

Referring now to FIG. 8, the frame 12 is tilted by extending the working cylinder 21. The region of the leading end 34 of the new printing plate 17 provided in the magazine 16 is consequently laid onto the suckers 28.

Figure 9:
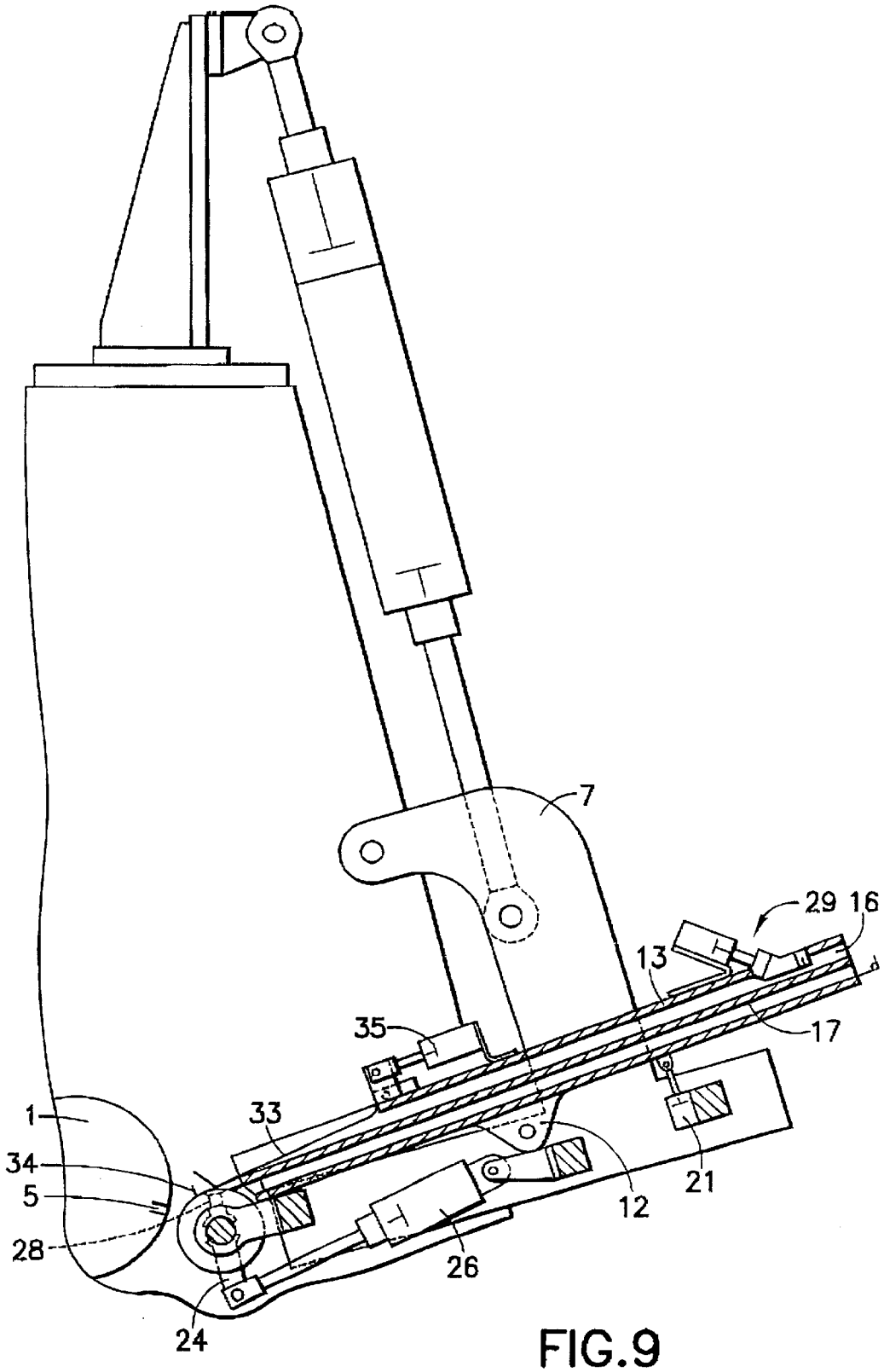
FIG. 9 is an apparatus according to FIG. 2 with the holding means removing the new printing plate from the magazine for inserting the printing plate with a leading, bent end of the printing plate being pressed onto the holding means by a retaining means.

Referring now to FIG. 9, the holding means 28 removing the new printing plate 17 from the magazine 16 is shown. The retaining means 33 presses the leading end 34 of the printing plate 17 onto the suckers 28 by extending the work cylinder 35. The printing plate 17 is picked up by the suckers 28, to which a vacuum (−P) is applied.

Figure 10:
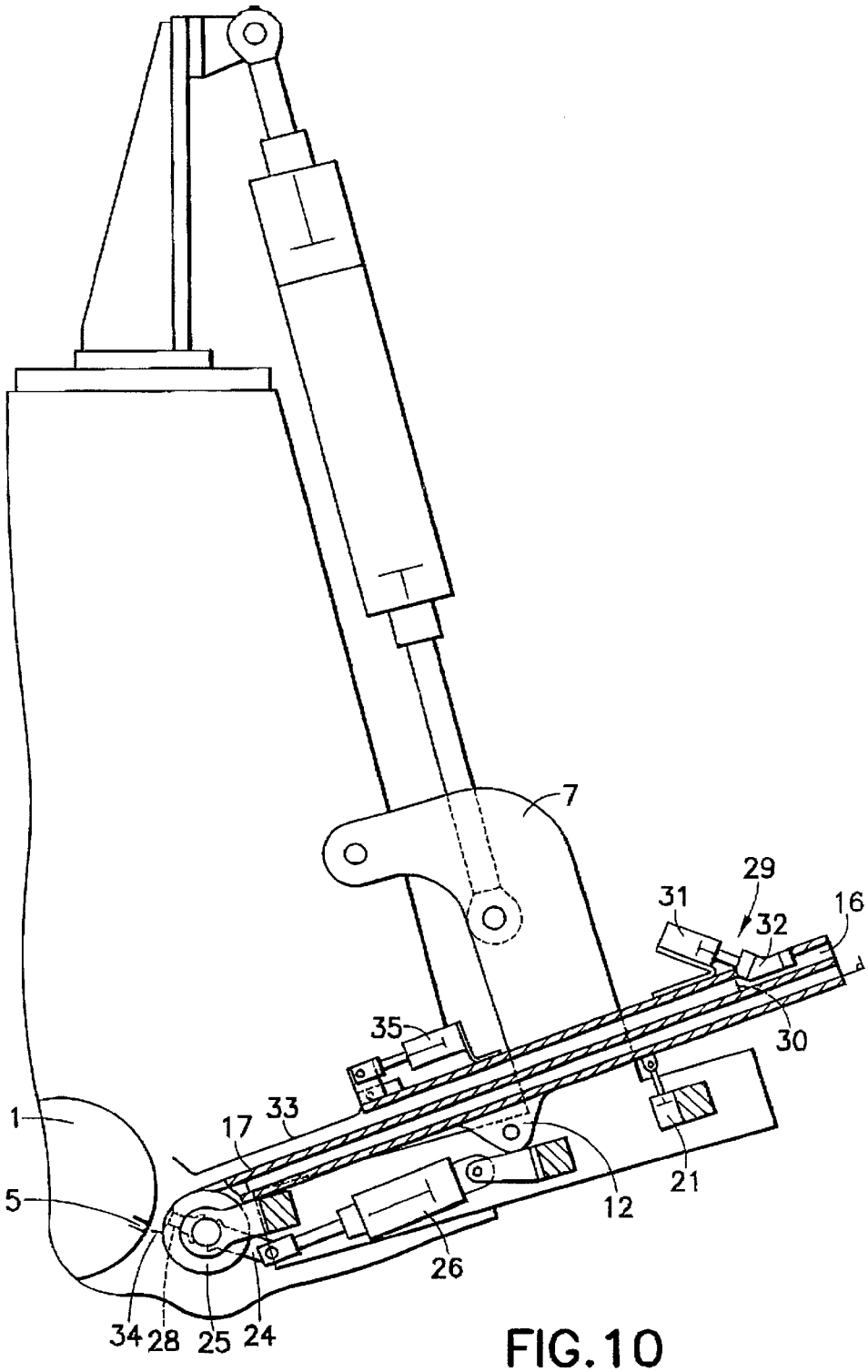
FIG. 10 is an apparatus according to FIG. 2 with the retaining means positioning the leading, bent end of the printing plate in front of the channel in the plate cylinder.

Referring now to FIG. 10, the holding means 28 positioning the lending bent end 4 of the printing plate 17 in front of the channel 5 is shown. Thus, after the arresting device 29 has been pivoted away, the bent leading end 34 of the printing plate 17, which has been pivoted by the suckers 28, has been placed radially in alignment with the channel 5 in the plate cylinder 1.

Figure 11:
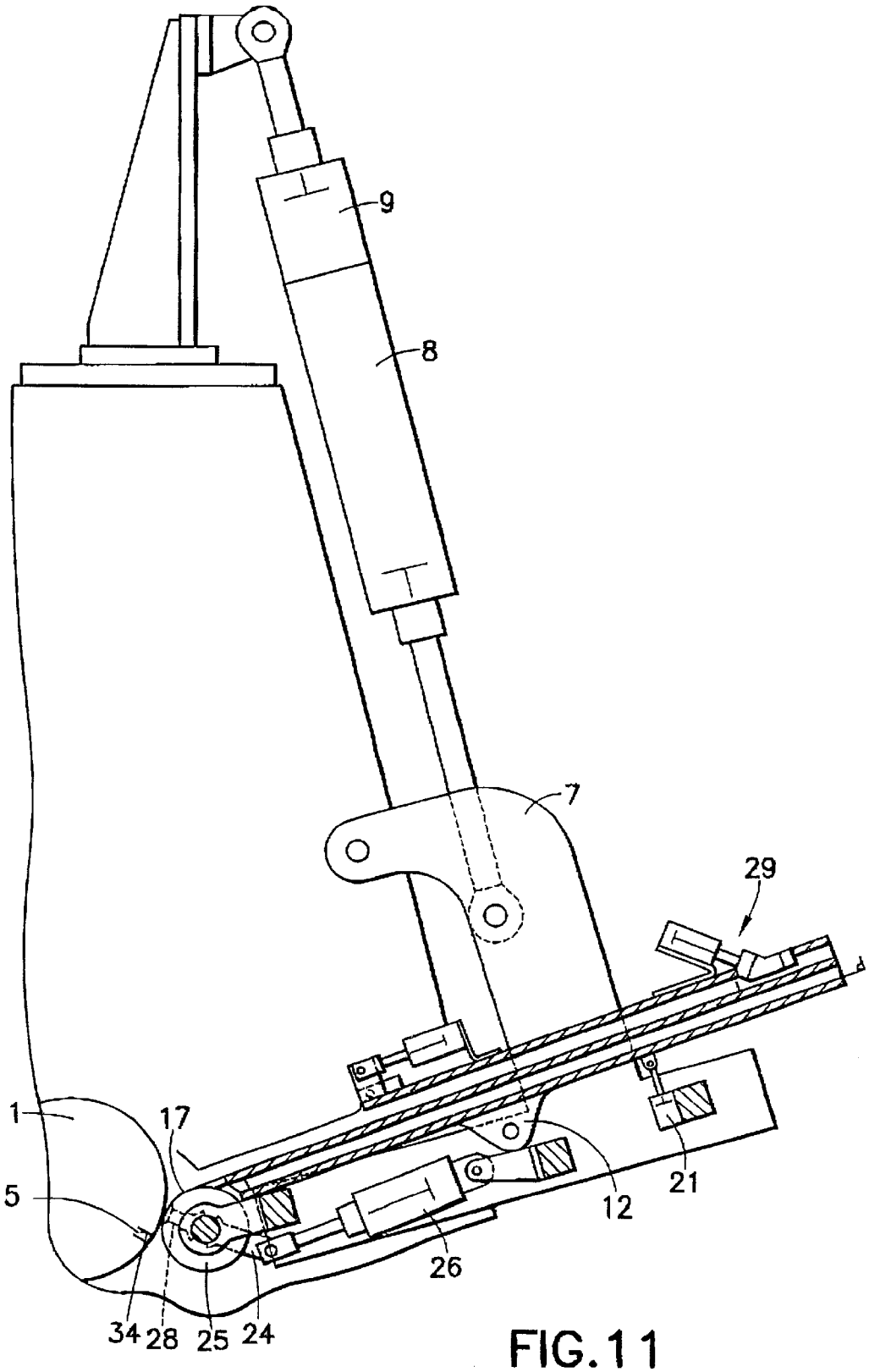
FIG. 11 is an apparatus according to FIG. 2 with the leading end positioned in the channel in the plate cylinder and holding means releasing the printing plate.

Referring now to FIG. 11, the leading bent end 4 of the printing plate 17 in the channel 5 with the holding means 28 releasing the printing plate is shown. The frame 7 has been set onto the plate cylinder 1 by extending the working cylinder 9. As a result, the bent leading end 34 has been inserted into the channel 5, and the printing plate 17 has been released from the suckers 28 by means of a pneumatic pressure pulse.

In a further step (not illustrated), the printing plate 17 is drawn fully onto the plate cylinder 1, as the plate cylinder 1 rotates, and the bent trailing end 30 of the printing plate 17 is pushed into the channel 5 by the supporting elements 25 during the rolling operation.

The apparatus subsequently pivots back into the park position again, the old printing plate 2 can be removed from the discharge opening 20, and a new printing plate 17 can be loaded into the feed opening 19.

Figure 12:
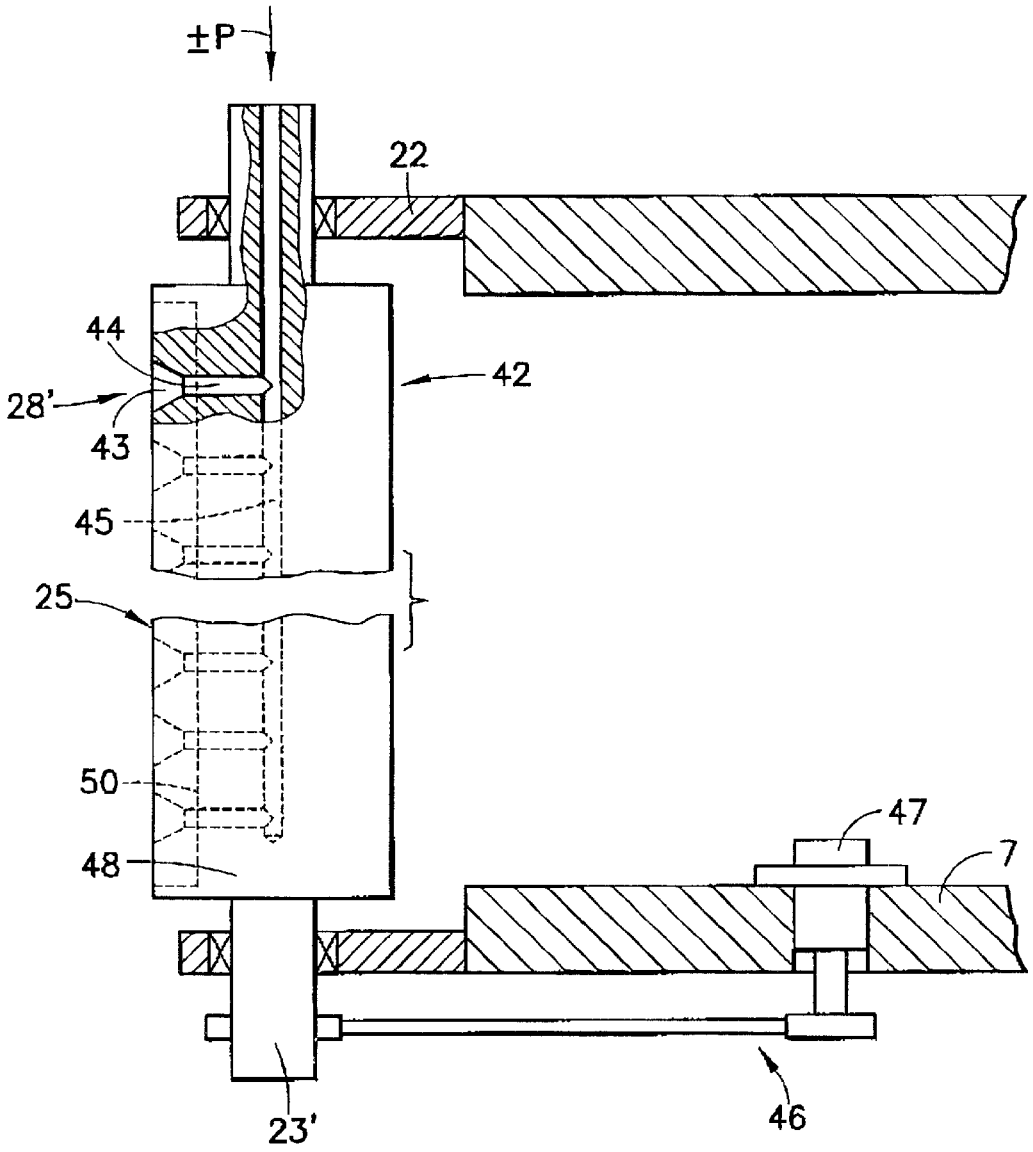
FIG. 12 is an apparatus according to the invention with a supporting body which is continuous over the width of the printing plate and is equipped with a suction zone, in a similar position to the apparatus shown in FIG. 2.

Referring now to FIG. 12, a further embodiment is shown. A supporting body 42 extends over the width of the printing plate 17 and has an axially parallel suction zone 43 over the circumference. The suction zone 42 is connected to an air supply system (not shown) via number of redial bores 44 and an axial bore 45 in the supporting body 42. The supporting body 42 is rotatably mounted on load-bearing elements 22 arranged in the frame 7 and, at its shaft 23', has a direct drive connection via flexible drive 46 to a motor 47 fixed to the frame 7. However, the supporting body 42 can also be connected to other drives, such as a working cylinder loaded by a pressure medium. Here, the piston rod of this working cylinder acts as the drive connection.

Figure 12A:
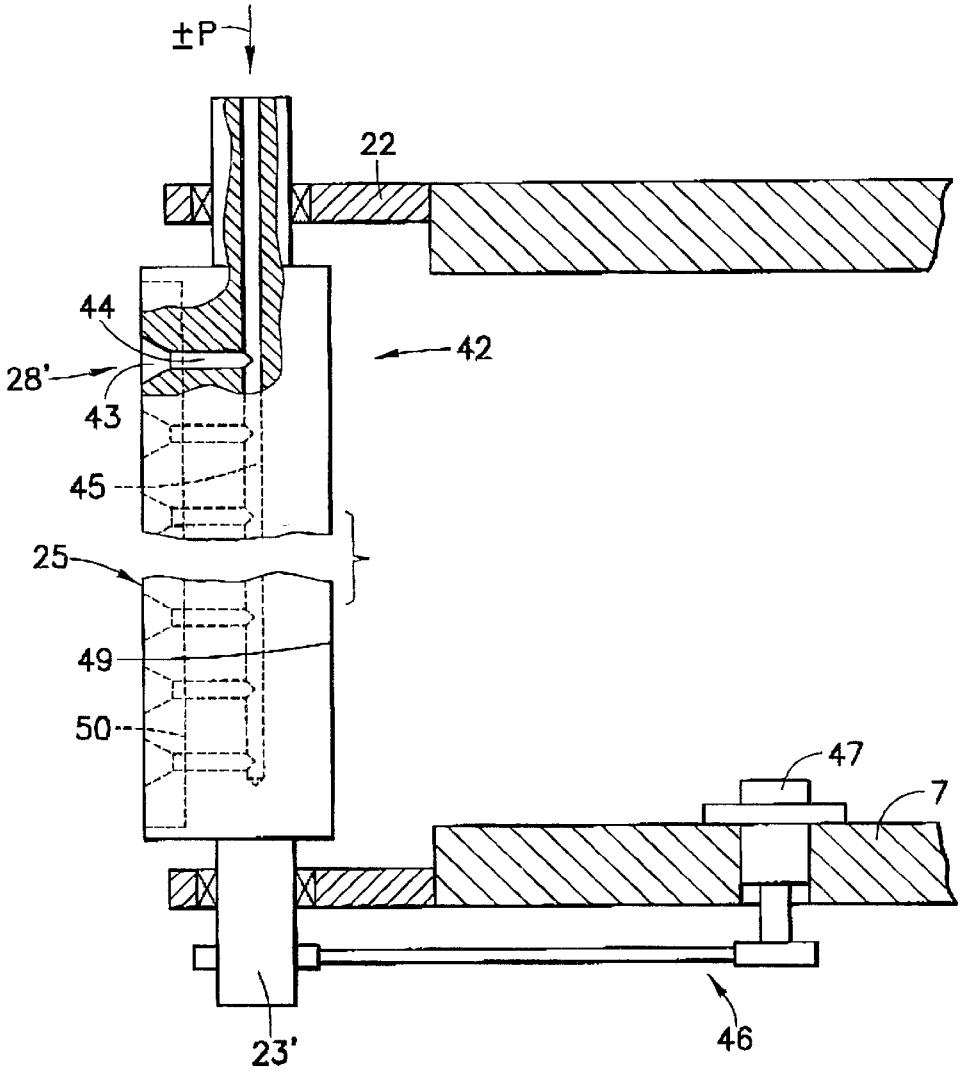
FIG. 12*a* is a view as in FIG. 12 of an alternative embodiment.

Referring now to FIGS. 12 and 12*a*, the supporting body 42 is designed as a roll 48. Since only a partial area of the circumference of the roll 48 is functionally necessary for changing the printing plate 2, 17, the supporting body 42 can also have the cross section of a circular segment 49, according to FIG. 12*a*. It is also possible to modify the holding means 28', by using, for example, a magnetizable adhering zone 50 on the circumference of the supporting body 42 instead of a suction zone 43. In this case, the printing plate 2, 17 must be prepared so that it can react to a magnetic force.

In addition to pivoting the apparatus for changing the printing plate towards and away from the plate cylinder 1, it is possible to move the entire apparatus out of the area of the printing unit 52 to allow for unimpeded maintenance of the printing unit 52, or parts thereof. For this purpose, the frame 7, the working cylinders 8, 9 and the supporting element 10 are arranged in an auxiliary frame 51, which is indicated by dashed lines in FIG. 1. The auxiliary frame 51 is mounted on the frame wall 6 and its location can be changed (i.e., matched to the respective local conditions) in relation to the printing unit 52 or parts thereof, y using a movement mechanism (such as a hand-driven actuating device 55) as is known in the prior art.

The action of changing the printing plate 2, 17 on the plate cylinder 1, described in FIGS. 1 to 11, can also be implemented with the aid of a control system 54 and/or a program which carry out the steps explained in FIGS. 1 to 11 automatically or semi-automatically.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An apparatus for changing flexible printing plates on a plate cylinder of a printing machine, comprising:

a printing machine;

a frame pivotally arrangable on the printing machine;

a first magazine and a second magazine, each being operatively arranged on the frame;

a shaft operatively arranged on the frame between the magazines and the plate cylinder, the shaft being axially arrangable parallel to the plate cylinder of a printing press;

a first printing plate operatively arranged on the first magazine;

a second printing plate operatively arranged on the second magazine;

transporting means pivotally arranged on the shaft for selectively transporting the first printing plate and the second printing plate toward and away from the plate cylinder of the printing machine; and holding means operatively arranged on the transporting means for both gripping and guiding one of the first and second printing plates.

2. The apparatus according to claim 1, further comprising:

at least one moveable supporting element curved in a direction opposite the plate cylinder of the printing machine and operatively arranged on the shaft so as to selectively support the first printing plate into the first magazine and the second printing plate into the second magazine during a plate change operation, the at least one moveable supporting element being adjacent to the plate cylinder.

3. The apparatus according to claim 2, the holding means being movable independent of the at least one supporting element, the at least one supporting element being extending in a direction of movement of the holding means.

4. The apparatus according to claim 3, wherein the transporting means comprises one of a lever moveable on the shaft, a disc and a circular segment.

5. The apparatus according to claim 4, further comprising one of a working cylinder fixed to the frame, an electromechanical motor and a screw-and-nut drive for pivoting the transporting means.

6. The apparatus according to claim 5, wherein the holding means is comprised of a suction device operatively attachable to an air supply system.

7. The apparatus according to claim 5, wherein the holding means comprises a magnetizable adhering zone.

8. The apparatus according to claim 2, wherein the at least one supporting element comprises one of a bar, a disc and a circular segment, wherein a circumference of the at least one supporting element is curved in a direction in which the holding means pivots.

9. The apparatus according to claim 2, wherein the holding means comprises a supporting body integral with the at least one supporting element, the supporting body being rotatably mounted on the shaft, wherein the holding means is arranged at a circumference of the supporting body.

10. The apparatus according to claim 9, wherein the supporting body is axially parallel to the shaft and has at least one of a magnetizable adhering zone and a suction zone connectable to an air supply system.

11. The apparatus according to claim 9, wherein the supporting body is configured as one of a roll and a segment having a circular cross section.

12. The apparatus according to claim 9, further comprising a motor fixed to the frame and drivably connected to the supporting body.

13. The apparatus according to claim 12, wherein the at least one supporting element has an area in contact with at least one of the first and the second printing plate, the area including a coating so as to reduce sliding of and prevent ink depositing on the printing plate.

14. The apparatus according to claim 1, further comprising:

at least one drive means for pivoting the frame, the drive means comprising one of a working cylinder operable by a pressure medium, an electromechanical motor and a screw-and-nut drive.

15. The apparatus according to claim 14, further comprising:

arresting means operatively arranged on the first magazine for arresting a trailing end of the first printing plate and for aligning the first printing plate in register;

inserting means operatively arranged on the second magazine for arresting a trailing end of the second printing plate and inserting the second printing plate into the second magazine; and retaining means having a drive, the retaining means being operatively arranged on the first magazine for driven placement against a leading end of the first printing plate.

16. The apparatus according to claim 15, further comprising:

an auxiliary frame moveable relative to the printing unit; and adjustment means operatively arranged on the auxiliary frame for adjusting the apparatus with respect to the printing unit, the adjusting means being one of an additional working cylinder operated by a pressure medium and a hand driven actuating device.

17. The apparatus according to claim 16, further comprising:

programmable control means for actuating a plate change operation.

18. The apparatus according to claim 17, further comprising:

a moveable frame operatively arranged on the frame, the moveable frame having means for adjusting the moveable frame relative to the frame, the adjustment means including at least one working cylinder operable by a pressure medium.

19. The apparatus according to claim 14, wherein the at least one drive means is operative to impart an insertion movement of a leading end of the first printing plate and a removal movement to a trailing end of the second printing plate.

20. A method of changing flexible printing plates on a plate cylinder of a printing machine, comprising the steps of:

feeding a first printing plate into a first magazine of an apparatus for changing flexible printing plates, the apparatus being in a park position;

aligning the first printing plate in register with an arresting device by setting the arresting device onto a trailing end of the first printing plate;

pivoting the apparatus into an operation position so as to fix a region of a trailing end of a second printing plate to a positioned, stationary plate cylinder;

setting holding means onto the trailing end of the second printing plate fixed to the positioned, stationary plate cylinder;

activating a holding force of the holding means;

inserting the second printing plate into a removal region of the second magazine while simultaneously rotating the plate cylinder and pivoting the holding means into a removal region of the second magazine;

deactivating the holding force of the holding means;

inserting the second printing plate further into the second magazine by rotating the plate cylinder;

pivoting the holding means into a region of a leading end of the second printing plate on the positioned, stationary plate cylinder;

activating the holding force of the holding means;

removing a bent leading end of the second printing plate from a channel in the plate cylinder by moving the apparatus away from the plate cylinder;

inserting the second printing plate further into the second magazine by pivoting the holding means into a leading end region of the second magazine;

fixing the trailing end of the second printing plate with an insertion device;

deactivating the holding force of the holding means;

inserting the second printing plate completely into the second magazine;

laying a leading end of the first printing plate onto the holding means by tilting a further frame;

pressing the leading end of the first printing plate onto the holding means with a retaining means;

activating the holding force of the holding means;

pivoting the arresting device away from the trailing end of the first printing plate;

pivoting the holding means with the bent leading end into radial alignment with the channel in the positioned, stationary plate cylinder;

inserting the bent leading end of the first printing plate into the channel of the printing cylinder by setting the apparatus onto the plate cylinder;

deactivating the holding force of the holding means;

drawing the first printing plate onto the plate cylinder while rotating the plate cylinder and then inserting the bent trailing end of the first printing plate into the channel;

pivoting the apparatus into the part position; and removing the second printing plate from the magazine.

* * * * *